US005150796A

United States Patent [19]

Pierson

[11] Patent Number: 5,150,796

[45] Date of Patent: Sep. 29, 1992

[54] RETRACTABLE, AIR PRESSURE ACTUATED HOLD-DOWN CLAMP

[75] Inventor: Bruce A. Pierson, Cincinnati, Ohio

[73] Assignee: Rotex, Inc., Cincinnati, Ohio

[21] Appl. No.: 732,036

[22] Filed: Jul. 18, 1991

[51] Int. Cl.[5] ..... B07B 1/00

[52] U.S. Cl. ..... 209/370; 209/372; 198/860.5; 248/500; 292/6; 292/45; 292/201; 292/247

[58] Field of Search ..... 209/370, 372; 198/735.5, 860.5; 248/499, 500, 510; 292/6, 25, 45, 110, 201, 246, 247

[56] References Cited

U.S. PATENT DOCUMENTS

| | | | |
|---|---|---|---|
| 1,874,482 | 8/1932 | Forman . | |
| 2,079,170 | 5/1937 | Horsley . | |
| 2,370,334 | 2/1945 | Wachter . | |
| 2,442,833 | 6/1948 | Watkins . | |
| 2,603,739 | 7/1952 | Steen . | |
| 2,776,854 | 1/1957 | Billstrom . | |
| 2,808,918 | 10/1957 | Shepard et al. | 292/201 |
| 3,113,352 | 12/1963 | Gibbs et al. | 292/201 |
| 3,368,711 | 2/1968 | Dubo | 292/247 |
| 3,433,357 | 3/1969 | Nolte | 209/372 |
| 3,797,882 | 3/1974 | Brimhall | 292/110 |
| 4,093,176 | 6/1978 | Contastin . | |
| 4,230,023 | 10/1980 | Ward . | |

*Primary Examiner*—Joseph E. Valenza

*Attorney, Agent, or Firm*—Wood, Herron & Evans

[57] ABSTRACT

Disclosed is a clamp for securing the cover of a screening machine. The clamp is air pressure operated, both to apply clamping force and to retract or swing the clamp out of the way when it is open. Super-atmospheric pressure is applied for clamping; subatmospheric pressure is applied to swing the clamp away. Multiple clamps may be simultaneously operated by pressure or vacuum from a common manifold.

12 Claims, 2 Drawing Sheets

RETRACTABLE, AIR PRESSURE ACTUATED HOLD-DOWN CLAMP

This invention relates to clamps, and more particularly to an air pressure operated clamp which is especially useful, among other purposes, for screening machines.

BACKGROUND

Commercial screening machines generally have a removable top cover which extends over a frame in which the screen is mounted. The cover encloses the material being screened, preventing it from being shaken off the screen, and minimizes dust. From time to time it is necessary to remove the cover, for instance to change or replace the screen. Because the frame and screen are shaken with substantial force in operation, the cover is typically clamped to the frame for movement with it. The particulate material to be screened is fed through the cover by an inlet chute which discharges it onto the screen.

Various forms of cover hold-down clamps have been proposed specifically for use on screening machines, including manually operated over-center hold-down clamps, for example of the type shown in Nolte U.S Pat. No. 3,433,357. In the use of such clamps, a clamp arm is manually engaged with the cover or frame or other member to be clamped and an arm is pulled from one side of a center position to the other side, so as to draw together the two members to be clamped. Such manual clamps provide a strong, inflexible clamping force. In order to provide an approximately uniform clamping force at the several clamps around the periphery of the frame (so that the cover is not held too tightly at one area and too loosely at another), each clamp must be manually turned or adjusted to provide roughly the same mechanical clamping force. In a large screening machine there may be as many as 16 clamps around the frame. When several such clamps must all be set and adjusted for uniform force, it often happens that the force of the first-set clamps is changed by the later-set clamps so that it is necessary to go back and readjust the first clamps. Such individual and repetitive adjustment requires substantial time, being done largely by trial and error. Moreover, the screws of such clamps over time become clogged with dust from the material being screened and tend to "gall" or seize so that they cannot be easily turned and adjusted.

In some applications screening machines are subjected to substantial heat in use, as for example when a hot material is being screened. Thermal expansion of the frame and/or cover elements caused by such heat puts a substantial load on a rigid mechanical clamps, making them difficult to open. In some circumstances the force of thermal expansion on a tightly set up clamp can even warp or deform the clamp.

Billstrom Pat. No. 2,776,854 teaches a hydraulic cylinder which when pressurized applies a clamping force to hold a flange against an adjacent surface. The application of pressure to the cylinder also swings a latch into clamping position. This is convenient because the latch automatically engages and disengages the clamping surface upon actuation and release of pressure.

Contastin Pat. No. 4,093,176 shows an air pressure operated clamp in which application of pressure irto a bellows moves a swingable latch member into position to engage beneath a member to be clamped. Upon release of air pressure the clamp is swung to open position by a compression spring. The position at which this occurs is not easily changed, being determined by the fixed geometry and the spring strength.

SUMMARY OF THE INVENTION

In accordance with this invention, a clamp is provided which has an inflatable, air pressure operated actuator. The actuator is expanded from its normal configuration by pressurization above atmospheric pressure; further, it is contracted by reduction of pressure below atmospheric. Several such clamps are provided around the screening machine, the actuator of each being connected to a common source of pressure and "vacuum" (i.e., less than atmospheric pressure). One end of each actuator is rigidly mounted to one of the members to be clamped, and a clamp arm mounted on the other or movable end of the actuator is engageable with the second member to be clamped. When pressurized, the actuator expands in length, that is, along the line of its central axis. The central axis is preferably aligned with a clamping surface of the member to be engaged. The actuator can be arranged either to press the clamp arm away from it, against the other member, or to draw the clamp arm toward it, against an overhanging clamping surface of the other member. Pressurization of the actuator moves the clamp arm axially against the second member, and thereby clamps the two together.

An asymmetrical stop is mounted to the actuator for movement with its movable end. The stop does not come into effect when the actuator is pressurized, but becomes active when the actuator is evacuated. The stop, being asymmetrical, then causes the actuator to contract non-uniformly by arresting contraction on one side of the axis of the actuator more than on its other side. The actuator is thereby tilted. Since the clamp arm is connected to the movable end of the actuator, it also is tilted, in a direction which swings it away from the clamping surface so that the cover or other member is free to be moved. The less the pressure acting in the actuator, the greater the cocking or degree of movement of the clamp arm. Reduction of the vacuum, back to atmospheric pressure, reduces the cocking and swings the clamp arm back into position to engage the clamp surface when the actuator is again pressurized. In effect, the clamp is swung into and out of clamping position by air pressure. Preferably, it is in clamping position when it is at atmospheric pressure.

This apparatus provides several advantages. If pressure is applied through a manifold from a common source, all the clamp arms are simultaneously swung into positions for clamping the member to be clamped (the screen frame for example). All are uniformly pressurized, and a uniform clamping force is thereby provided around the cover, without manually operating each clamp. When it is necessary to open the machine, pressure is released and vacuum is drawn on all the actuators, to contract them. Not only is the clamping force released, the clamp arms are also swung out of engagement with the clamping surfaces so that the cover can be lifted without manually removing each clamp. Moreover, if the screening device is operated hot, thermal expansion does not over stress the clamp arm; it merely compresses air in the actuator. If excessive, the actuator pressure can open a safety valve.

DESCRIPTION OF THE DRAWINGS

The invention can best be further described by reference to the accompany drawings, in which.

DETAILED DESCRIPTION

Figure 1:
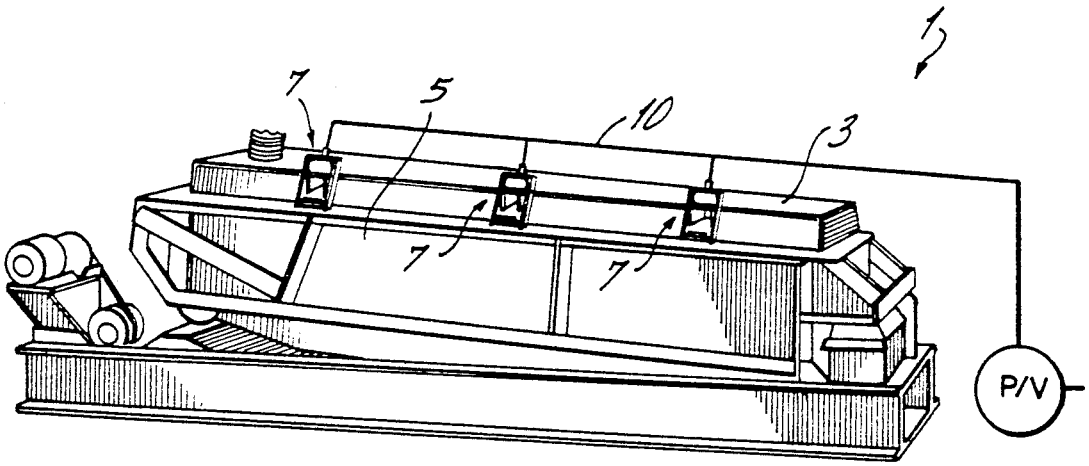
FIG. 1 is a perspective view of one type of screening machine having pressure operated hold down clamps in accordance with the present invention.
Figure 2:
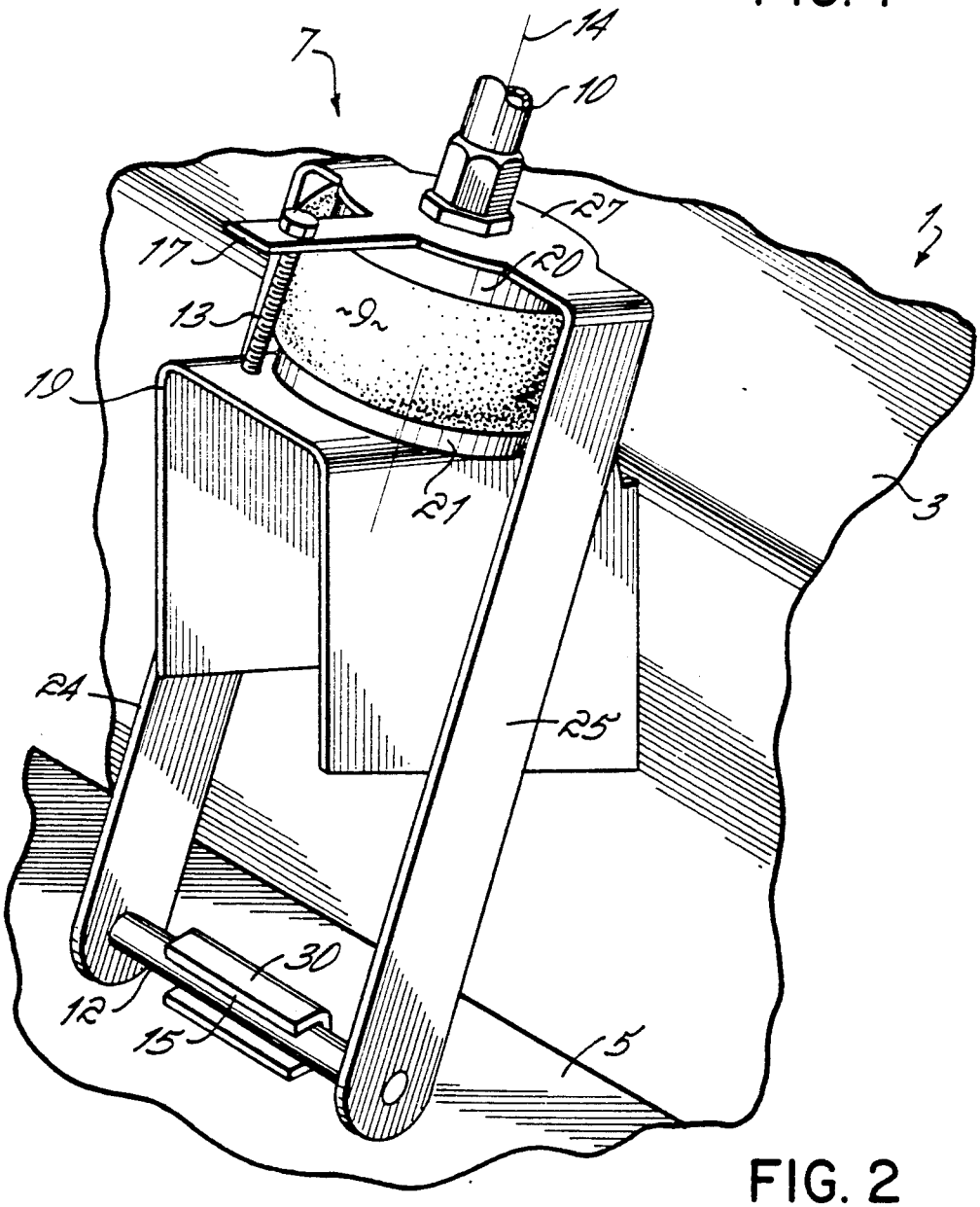
FIG. 2 is an enlarged perspective view, partly broken away, of a single clamp in accordance with a preferred embodiment of the invention, showing the clamp in clamping position.
Figure 4:
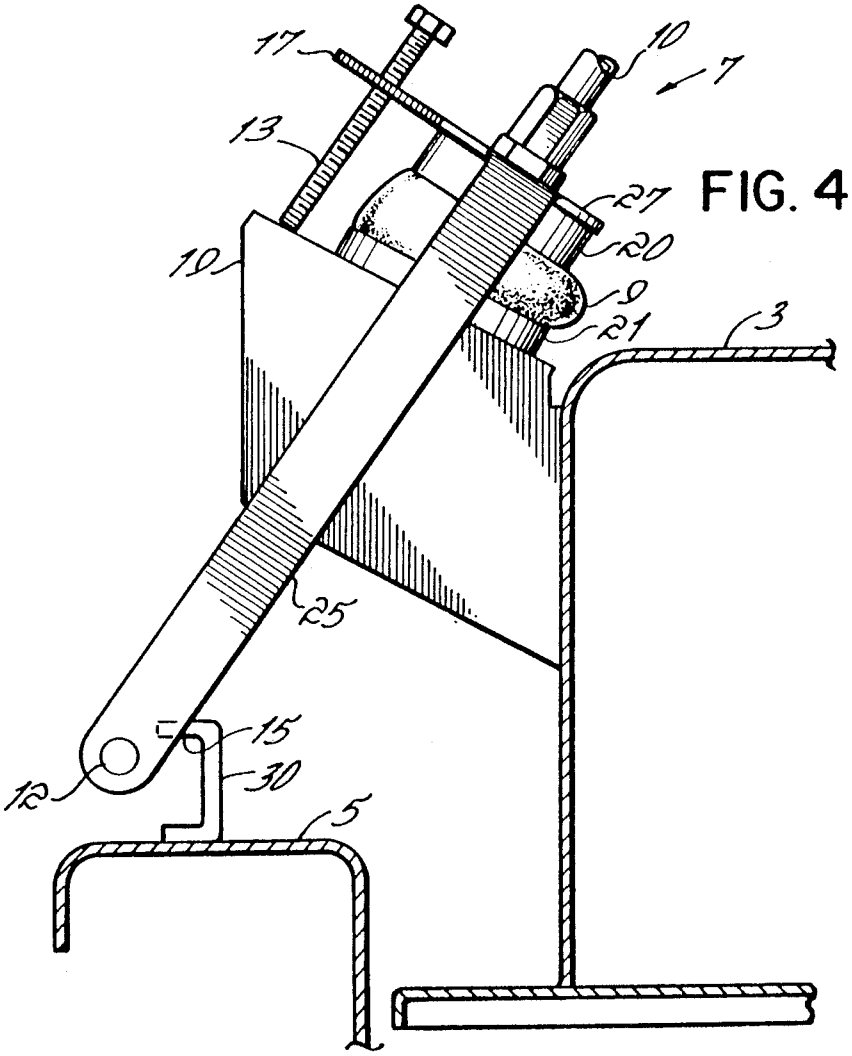
FIG. 4 is a side elevation similar to FIG. 3 but shows the position of the clamp when the actuator has been evacuated to disengage the clamp arm from the clamping surface and move it to a retracted position.
Figure 3:
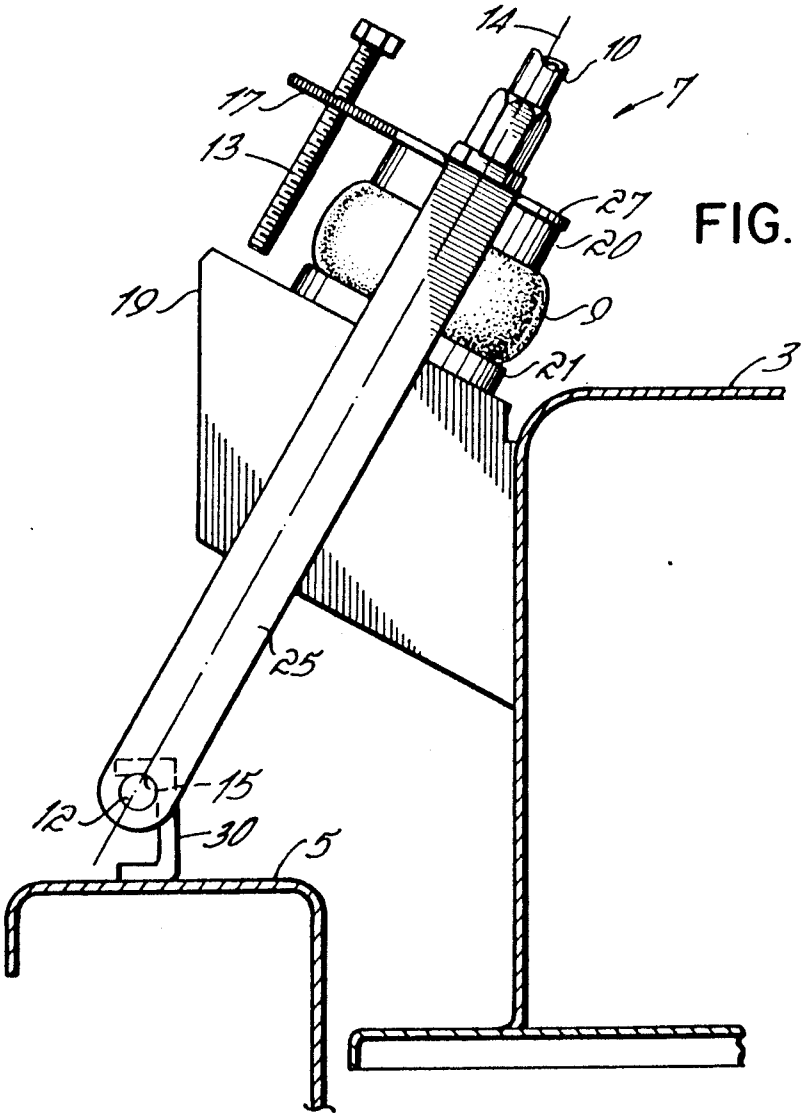
FIG. 3 is a side elevation, partly in section, showing the clamp in clamping position.

In a broad sense the clamp of this invention is useful to secure a first member to a second member. In its preferred embodiment the clamp is used to secure components of a screening machine 1, shown in FIG. 1. The screening machine includes a top cover 3 which is clamped onto a box frame 5. Machines of this general type are sold commercially, one example being the "Rotex" screeners made and sold by the assignee of this application. A series of clamps, each designated by 7, is mounted around the edge of top cover 3 and are engageable with frame 5 to clamp the cover to it. (It will be appreciated that alternatively the clamps could be mounted to the frame, to clamp to the top cover.) The machine 1 shown has several such clamps around its periphery, three of which are shown in FIG. 1 for purposes of illustration. A single clamp 7, shown in FIGS. 2–4, comprises a balloon or bellows-like air actuator 9 made of an airtight flexible material and having an internal chamber into which air can be supplied or withdrawn through a conduit line 10. Actuator 9 has end plates 20, 21 at its upper and lower ends respectively. It is symmetrical about its center axis 14, and air line 10 preferably centers the actuator through end plate 20, on the axis. Admission of pressure to the actuator expands it axially (FIG. 3); removal of air contracts it (FIG. 4). Such actuators are commercially available, a preferred type being model No. 1M1A, made by Firestone. The lower or base plate 21 of air actuator 9 is mounted to a bracket or shelf 19 on the cover, so that when pressure is applied, the top plate 20 moves perpendicularly away from shelf 19.

A clamp bracket 11, having two parallel downwardly extending clamp arms 24, 25 (FIG. 2) is centered on and mounted to actuator upper end plate 20, the arms 24, 25 straddling the actuator and extending downwardly for engagement with the frame 5. A pin or bolt 12 is cross-connected between holes in the ends of the arms 24, 25. Bracket 11 has a center plate 27 which is mounted to the top plate 20 of actuator 9. The cross pin 12 is engageable in a C-shaped channel 30 secured to frame 5. The channel presents an overhanging flange or clamping surface 15. The axis 14 of actuator 9, if extended, preferably passes through the channel 30 at the angle where flange 15 meets the back wall of the channel (see FIG. 3).

Conduit 10 can selectively be vented to atmosphere or connected either to a source of pneumatic super-atmospheric pressure or sub-atmospheric pressure, the source being designated as "P/V" in FIG. 1. At atmospheric pressure (i.e., when line 10 is vented) the actuator will be in its normal configuration, in which pin 12 is positioned slightly below clamping surface 15. When air pressure is applied through line 10 the actuator inflates, expanding and pulling the clamp arms 24, 25 toward it and thereby drawing pin 12 against clamping surface 15. Operating pressure for clamping may for example be in the range of about 20 to 100 psia, depending on the size of the machine, desired force and other factors. The Firestone brand 1M1A actuator referred to above exerts a force of 600–700 pounds when pressurized to 95 psia. The subatmospheric pressure for retracting the clamp may be in the range of about 8–12 psia.

An arm 17 extends outwardly or radially from the top of actuator 9, this arm preferably being formed integrally with bracket 11. Arm 17 extends parallel to and between the two straps or clamp arms 24, 25, beyond the diameter of the actuator. An adjustable stop 13, which may conveniently be a bolt threaded through an opening in arm 17, extends parallel to but offset from the axis of the actuator.

Pneumatic line 10 is connected to all of the clamps (FIG. 1), so that application of pneumatic pressure in line 10 clamps all of the actuators simultaneously and at the same pressure. This operates all the clamps simultaneously, insures that the clamping force is uniform around the cover, and eliminates the need to adjust each clamp individually. Clamping force can be adjusted incrementally, by changing the applied air pressure. Unlike screw clamps, the air actuator does not gall or seize, even at high pressure.

Reducing the pressure inside actuator 9 below atmospheric pressure contracts the actuator in the axial direction. This moves top plate 20 closer to bottom plate 21 and therefore shifts pin 12 away from clamping surface 15. It also brings stop 13 into endwise engagement with stop arresting means such as bracket 19. The off-center position of stop 13 limits further contraction of the actuator on one side of its axis 14 (the left side in FIG. 4) while the actuator continues to contract on the other side of the axis. This cocks top plate 20 and bracket 11 mounted to it, thereby swinging pin 12 out of channel 15 to the retracted position of FIG. 4. The closer stop 13 is to the center axis, the greater the swing for a given axial contraction. As an example, the 1M1A type actuator previously referred to, having a clamp with 11" arms (top to pin), and having a stop which is $2\frac{1}{2}$" off center, is decreased in height by about $\frac{5}{8}$" at a pressure of 10 psia (subatmospheric) and swings the pin about 1" away from channel 15.

When pin 12 disengages clamping surface 15, the cover 3 is freed and may be removed. The air actuator returns to its normal clamp engaged configuration (FIG. 3) when the pressure inside it is returned to atmospheric pressure.

Having described the invention, what is claimed is:

1. An air pressure actuated hold-down clamp for securing a first member and a second member comprising, an inflatable air actuator having a fixed end and a movable end, said fixed end mounted to said first member, said actuator being expanded from a normal attitude by internal pressurization and contracted from the normal attitude by sub- atmospheric internal pressure, a clamping surface provided by said second member, a clamp arm mounted to a movable end of said actuator, said clamp arm being moved against said clamping surface when said actuator is pressurized thereby to clamp said second member relative to said first member, and a stop asymmetrically mounted to said movable end of said actuator for movement therewith, contraction of said actuator under sub-atmospheric pressure moving said stop into engagement with a fixed surface, the asymmetric mounting of said stop thereupon tilting said actuator and swinging said clamp arm away from said clamping surface.

2. The clamp of claim 1 wherein said actuator has a central axis which is aligned with said clamping surface when said actuator is at said reference pressure.

3. The clamp of claim 1 wherein said pressurization of actuator draws said clamp arm against said clamping surface and puts said arm in tension.

4. The clamp of claim 1 wherein said clamp arm is mounted to an end of said actuator which is moved away from said clamping surface when said actuator is pressurized.

5. The clamp of claim 1 wherein said actuator has two clamp arms, said arms being legs of a U-shaped bracket.

6. The clamp of claim 5 wherein said U-shaped bracket is mounted on an end of said actuator which is moved away from said clamping surface when said actuator is pressurized and toward said surface when said actuator is contracted.

7. The clamp of claim 1 wherein said clamping surface is presented by a flange, and said tilting moves said arm away from said flange.

8. The clamp of claim 1 wherein said stop lies to one side of said actuator.

9. The clamp of claim 1 wherein said stop is adjustably positionable along a line parallel to a central axis of said actuator.

10. The clamp of claim 1 wherein said actuator includes a pneumatic pressure port on a central axis of said actuator.

11. A screening machine having a screen box mounting a screen, a removable top cover on said box, and a series of clamps for clamping said cover on said each said clamp comprising an inflatable air actuator having a fixed end and a movable end, said fixed end mounted to one of said cover and said box, said actuator being expanded from a normal attitude by internal pressurization and contracted from normal attitude by subatmospheric internal pressure, a clamping surface provided by the other of said cover and said box, a clamp arm mounted to said movable end of said actuator, said clamp arm being urged against said clamping surface by pressurizing said actuator, a stop asymmetrically mounted to said movable end of said actuator for movement therewith, contraction of said actuator under sub-atmospheric pressure moving said stop into engagement with a fixed surface, the asymmetric mounting of said stop thereupon tilting said actuator and swinging said clamp arm away from said clamping surface, the actuators of said clamps being connected to common supply means for selectively supplying pressure air or sub-atmospheric pressure to them, whereby all said clamps are operated simultaneously by said supply means.

12. A screening machine having a screen box mounting a screen, a removable top cover on said box, and a series of spaced clamps mounted for clamping said cover and said box together, each said clamp comprising an inflatable air actuator having a fixed end and a movable end, said fixed end mounted to one of said cover and said box, said actuator being expanded by internal pressurization, a clamping surface provided by the other of said cover and said box, a clamp arm mounted to said movable end of said actuator, said clamp arm being urged against said clamping surface by pressurizing said actuator, the actuators of said clamps being connected to common pressure supply means, whereby all said clamps are operated simultaneously by said supply means.

* * * * *